US005791936A

United States Patent [19]

Nicholson

[11] Patent Number: 5,791,936

[45] Date of Patent: Aug. 11, 1998

[54] PROTECTIVE COVER FOR GROUND JUNCTION CONNECTOR

[75] Inventor: James Bradford Nicholson, Canton, Mich.

[73] Assignee: Yazaki Corporation, Tokyo, Japan

[21] Appl. No.: 667,844

[22] Filed: Jun. 20, 1996

[51] Int. Cl.[6] ..... H01R 13/52

[52] U.S. Cl. ..... 439/521; 439/801

[58] Field of Search ..... 439/521, 367, 439/519, 522, 502–504, 754, 801, 883, 467, 718

[56] References Cited

U.S. PATENT DOCUMENTS

| | | | |
|---|---|---|---|
| 4,952,155 | 8/1990 | Kuzuno et al. | 439/49 |
| 5,201,667 | 4/1993 | Endo et al. | 439/189 |
| 5,338,898 | 8/1994 | Luciano et al. | 439/521 X |
| 5,346,407 | 9/1994 | Hood | 439/522 |
| 5,371,323 | 12/1994 | Schneider et al. | 439/367 |
| 5,413,500 | 5/1995 | Tanaka | 439/521 |
| 5,439,759 | 8/1995 | Lippert et al. | 429/65 |

*Primary Examiner*—Khiem Nguyen
*Attorney, Agent, or Firm*—Young & Basile, P.C.

[57] ABSTRACT

A protective cover for substantially completely enclosing a ground junction connector to inhibit contamination of the electrical contact surfaces of the ground junction connector when it is in use. The cover comprises a housing that fits over the ground junction connector and an end cap which matingly engages the housing to trap the ground junction connector in an enclosed position within the housing. The housing has a lower surface with a bolt hole formed therein and an upper surface with a larger access hole formed therein. The holes are in coaxial alignment with one another so that a bolt may be inserted through the access hole, into engagement with an eyelet attached to the ground junction connector, and out through the bolt hole to connect with the ground point. The end cap has a wire hole through which a wire harness attached to the ground junction connector extends. A lid is attached to the housing by a hinge and seals the access hole when in a closed position.

17 Claims, 2 Drawing Sheets

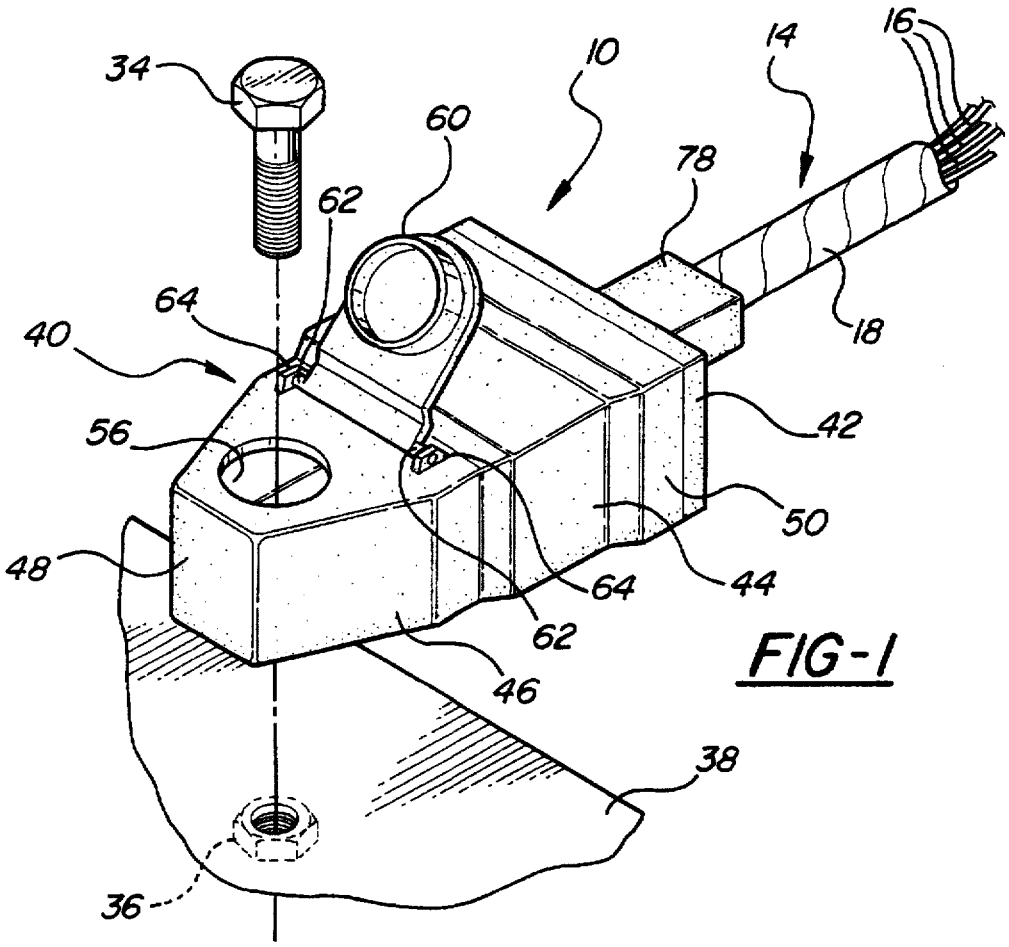
FIG-1
FIG-2
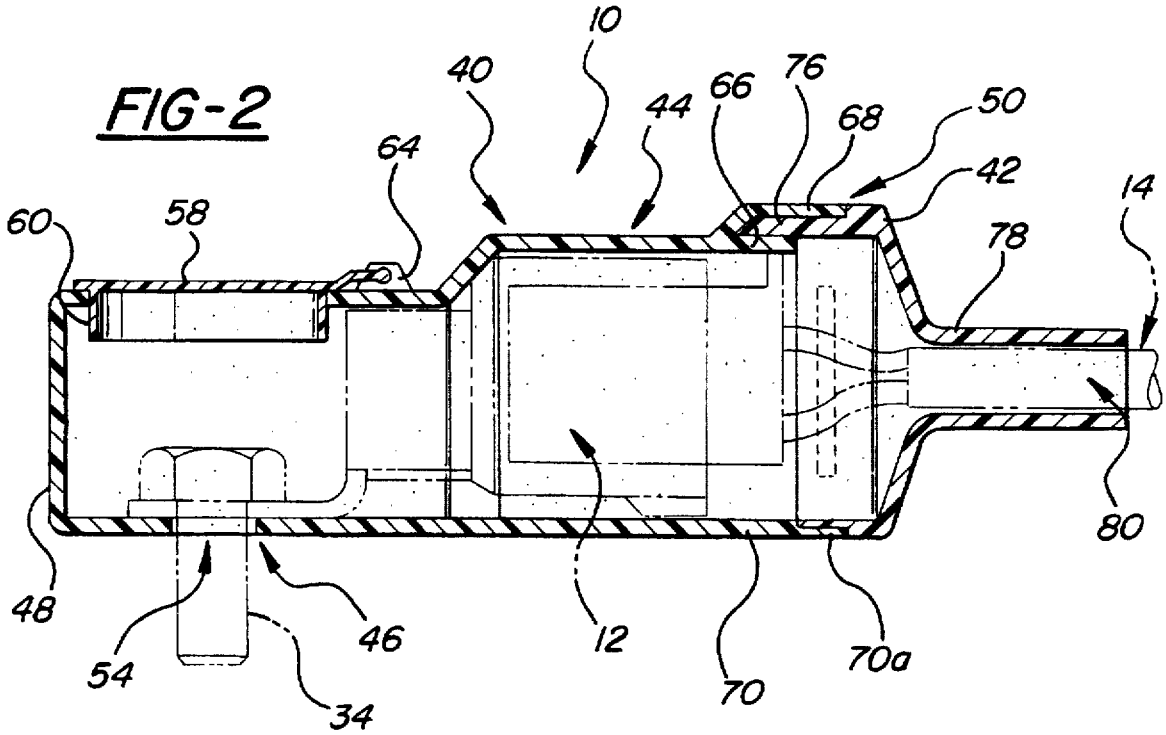

FIG-3
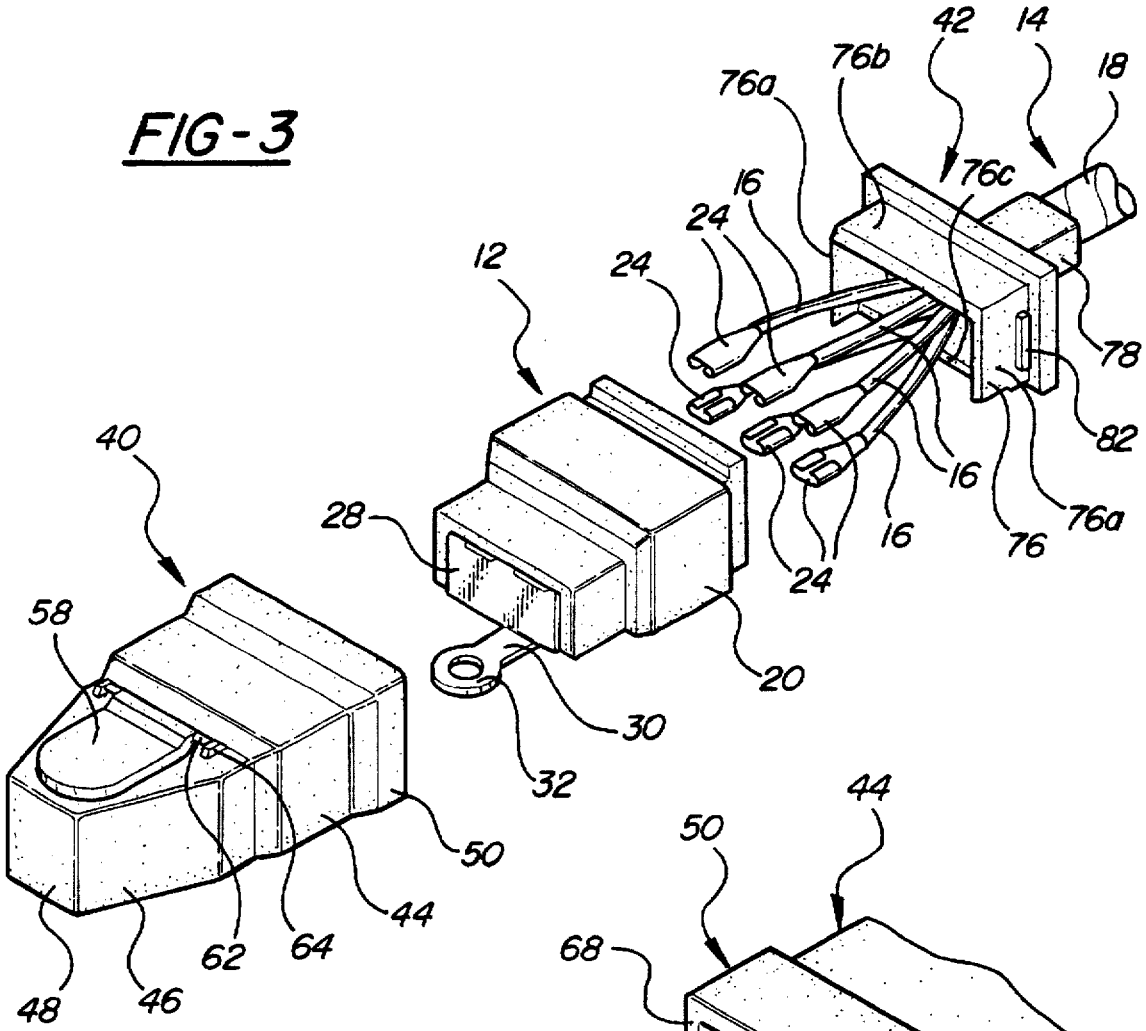
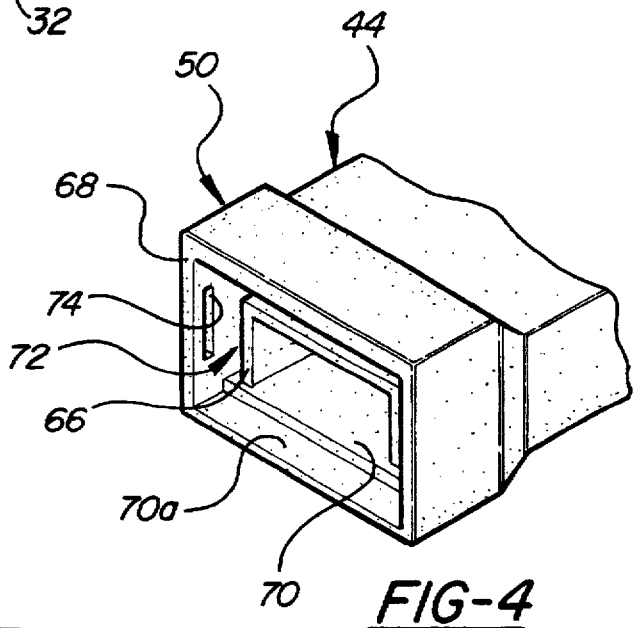
FIG-4
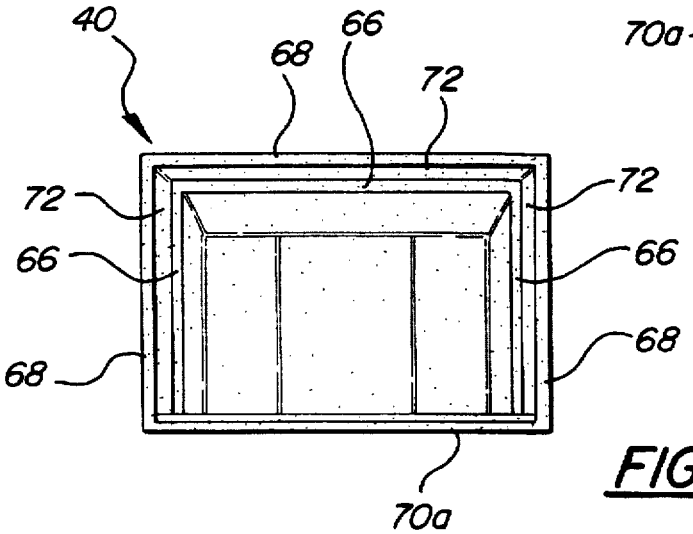
FIG-5

PROTECTIVE COVER FOR GROUND JUNCTION CONNECTOR

FIELD OF THE INVENTION

The present invention relates to ground junction connectors used to secure a wire or wire harness to an electrically grounded component, and more specifically to a protective cover for enclosing a ground junction connector to protect the ground junction connector from solid and liquid contaminants and corrosion that may eventually be caused thereby.

BACKGROUND OF THE INVENTION

Automotive vehicle electrical systems typically employ ground junction connectors to provide a common electrical ground for various electrical circuits and components making up the system. A ground junction connector is connected to the wires making up a wire harness and is secured by a bolt or the like in electrical connection with a ground point such as a sheet metal body panel or some other piece of metal structure.

Ground junction connectors are often located in the engine compartment of the vehicle, and consequently are exposed to water, dirt, road salt and other contaminants that may splash up into the engine compartment during operation of the vehicle. Contamination of the ground junction connector by such contaminants may over time cause corrosion at the surfaces of electrical contact between the ground junction connector and the ground point, and between the wires terminals and the ground junction connector. Corrosion increases the electrical resistance between the contact surfaces, thereby reducing the effectiveness of the grounding connection. As the contact surfaces continue to corrode, the electrical resistance increases and eventually reaches a level where the grounding connection is effectively an open circuit. At this point, the electrical circuits connected to the ground junction connector do not have an adequate electrical ground, causing the circuits to malfunction.

A typical prior art ground junction connector comprises a plastic connector body having a plurality of apertures formed in a first end for receiving terminals which are crimped to the ends of wires. A metal busbar is inserted into an opposite end of the connector body to make electrical contact with the terminals within the body. A circular eyelet is formed integrally with the busbar and extends from the body so that it may be bolted to a metal component such as a body panel which provides the ground point. Such a ground junction connector does not, by itself, provide a waterproof seal around the busbar/terminal interface, and the eyelet/ground point interface is completely unprotected.

One prior art method for inhibiting corrosion of the ground junction connector is to coat the exposed surfaces of the terminals and the busbar with grease. Grease, however, is difficult to apply consistently and so may not fully cover the contact surfaces. Additionally, the grease is not permanent and may be forced away from the electrical contact surfaces due to water pressure, air pressure or relative movement between the contact surfaces. Furthermore, certain greases have been known to cause deterioration of the wire insulation, thereby allowing corrosion of the wire itself.

Co-pending U.S. patent application Ser. No. 08/433,244, filed May 2, 1995, discloses a ground junction connector wherein the connector body has a hinged lid that closes over the busbar and, together with a rubber grommet housed within the body, provides a seal against penetration of contaminants into the interior of the body and the busbar/terminal interface. No protection is provided, however, for the eyelet and its connection with the ground point.

SUMMARY OF THE INVENTION

The present invention is directed toward providing a protective cover which completely encloses a ground junction connector to inhibit contamination of the electrical contact surfaces of the connector when it is in use, and which does so without interfering with connection or disconnection of the ground junction connector to/from a ground point.

The invention cover comprises first and second housing portions adapted to matingly engage one another so as to substantially surround the ground junction connector. The first housing portion has two holes formed therein, one permitting electrical contact between the ground junction connector and the ground point and the other permitting access to the ground junction connector to connect or disconnect it from the ground point. The second housing portion has a third hole permitting passage therethrough of a wire harness attached to the ground junction connector. The invention protective cover is easily assembled with the ground junction connector and the wire harness, and this assembly may be accomplished concurrently with fabrication of the wire harness to produce a completed unit for shipment to an automobile assembly plant where it is installed in the vehicle.

In the preferred embodiment of the invention described herein, the protective cover is adapted for use with a prior art ground junction connector and wire harness such as are commonly used in automotive vehicle applications. The ground junction connector comprises a plastic connector body having a plurality of apertures for receiving terminals at the ends of individual wires which make up the wire harness, a plastic frame which fits over the connector body, and a metal busbar which is retained inside the connector body/frame combination. The busbar has a plurality of tabs for mating with the terminals and an eyelet to accept a bolt which is threaded into engagement with the ground point to secure the busbar in electrical contact therewith.

According to the invention, the first housing portion receives the ground junction connector so that the eyelet is positioned between spaced upper and lower surfaces of the housing. A first hole is formed in the lower surface and a larger second hole is formed in the upper surface, and the two holes are in coaxial alignment with one another. Accordingly, the eyelet may be positioned directly between the holes such that the bolt projects through the first hole and is accessible through the second hole with a wrench or the like to tighten the bolt into engagement with a nut welded to the ground point.

According to a feature of the invention, the second hole is provided with a removable lid which seals the hole against the penetration of contaminants when closed and permits access to the bolt when opened. In the preferred embodiment of the invention, the lid is connected to the first housing portion by a hinge for movement between the open and closed positions.

According to another feature of the invention, the first housing portion has an open end for receiving the ground junction connector and inner and outer skirts are formed around at least a portion of the periphery of the open end to define a gap between the two skirts, and the second housing portion has a peripheral wall extending therefrom and sized to fit snugly into the gap when the two housing portions are engaged with one another. The mating engagement between the skirts and the peripheral wall produces a seal that effectively resists the penetration of solid and liquid contaminants under most foreseeable operating conditions.

According to a further feature of the invention, at least one groove is formed in an inner surface of the outer skirt proximate the gap and at least one ridge projects outwardly from the peripheral wall, the groove and ridge configured to latchingly engage one another when the peripheral wall is inserted into the gap. Engagement between the ridges and their respective grooves secures the first and second housing portions together and effectively resists inadvertent disconnection of the two pieces.

These and other features and advantages of the present invention will become apparent upon reading of the following detailed description of the preferred embodiment and viewing of the drawings.

BRIEF DESCRIPTION OF THE DRAWINGS

FIG. 1 is a perspective view of the invention cover prior to connection with a ground point;

FIG. 2 is vertical cross-sectional view taken along the longitudinal centerline of the invention cover;

FIG. 3 is an exploded perspective view of the invention cover in combination with a ground junction connector and a wire harness;

FIG. 4 is a partial perspective view of the housing portion of the invention cover; and FIG. 5 is an elevation view looking into the open end of the housing portion of the invention cover.

DETAILED DESCRIPTION OF THE PREFERRED EMBODIMENT

FIGS. 1 and 3 depict a protective cover 10 according to the present invention in combination with a ground junction connector 12 and wire harness 14 such as are commonly used in an automotive vehicle electrical system. Wire harness 14 comprises a plurality of individual wires 16 bundled together and surrounded by a flexible casing 18, and ground junction connector 12 terminates an end of the wire harness.

Referring to FIG. 3, ground junction connector 12 comprises a plastic connector body 20 having a plurality of apertures (not shown) formed in a first end for receiving terminals 24 crimped to the ends of wires 16, and a metal busbar 28 retained inside the connector body adjacent an opposite second end. Busbar 28 mates with the terminals within connector body 20 and has a circular eyelet 32 extending therefrom to accept a bolt 34 (see FIG. 1). After passing through eyelet 32, bolt 34 is threaded into engagement with a nut 36 welded or otherwise attached to a metal component such as a body panel 38.

Protective cover 10 comprises a housing 40 and an end cap 42 which fit together to substantially completely enclose ground junction connector 12. Housing 40 and end cap 42 are both made of a dielectric plastic material, such as high density polyethylene or polypropylene, and preferably are injection molded. Other materials could be used as long as the strength of the material is sufficient to withstand the force applied when the grounding bolt is tightened.

Housing 40 is hollow and comprises a rectangular center section 44; a smaller, tapering forward section 46 which narrows slightly toward a closed tip 48; and a rear section 50 which flares outwardly toward a rear opening. Forward section 46 has substantially parallel upper and lower walls, and a bolt hole 54 is formed in its lower wall and a larger access hole 56 formed in its upper wall at a position substantially coaxial with the bolt hole.

A molded plastic lid 58 is hingedly attached to housing 40 adjacent access hole 56. Lid 58 has a flat upper surface and a short, open-bottomed, cylindrical plug 60 extending downward therefrom. A pair of pins 62 project outwardly in opposite directions from an end of the lid and engage hinge ears 64 formed integrally with the upper wall of housing forward section 46. Plug 60 is of the proper diameter to fit snugly inside of access hole 56 when lid 58 is moved to a closed position.

As may best be seen in FIG. 4, housing rear section 50 comprises an inner skirt 66 extending directly rearward from the upper and lateral walls of housing center section 44, an outer skirt 68 which flares outwardly from the upper and lateral walls of the center section before extending rearwardly parallel to the inner skirt, and a lower wall 70 having a reduced thickness section **70*a* adjacent its rearmost edge. Outer skirt 68 extends beyond the rearmost edge of inner skirt 66, and a gap 72 is defined between the inner and outer skirts. A shallow groove 74 is formed in the interior surfaces of both lateral walls of outer skirt 68** adjacent their rearmost edges.

End cap 42 is generally funnel-shaped, having a peripheral wall 76 defining a relatively large rectangular opening at a first end and a tapering neck portion 78 defining a smaller wire hole 80 at an opposite end. Peripheral wall 76 comprises two lateral walls **76*a* and an upper wall 76*b* having chamfered forward edges, and a lower wall 76*c* that is thinner than the other three walls and does not project as far forward. A vertically oriented ridge 82 is formed on the exterior surface of each lateral wall 76*a*. In the embodiment of the invention depicted, wire hole 80** is oval or elongated in shape, but may be any shape necessary to conform to the cross-sectional shape of the wire harness with which the protective cover is to be used.

To assemble protective cover 10 with wire harness 14 and ground junction connector 12, wires 16 are first threaded through wire hole 80 of end cap 42 so that terminals 24 project out through the rectangular opening formed by peripheral wall 76, as seen in FIG. 3. Next, terminals 24 are inserted into connector body 20 to make mating contact with busbar 28. Housing 40 is then placed over ground junction connector 12 so that the connector is positioned within housing center section 44 and eyelet 32 is aligned with bolt hole 54 and access hole 56, and end cap 42 is moved along wire harness 14 toward the ground junction connector 12 and into mating contact with the housing. Peripheral wall 76 of end cap 42 is sized to fit inside of the housing rear opening, the lateral and upper walls **76*a*, 76*b* sliding into gap 72 and lower wall 76*c* overlapping the reduced thickness section 70*a* of lower wall 70 as seen in FIG. 2. When housing 40 and 42 are urged into full engagement with one another, ridges 82 fit into grooves 74 to provide a locking effect and hold the two cover components together. The fit between peripheral wall 76 and gap 72 is snug enough to provide a substantially liquid- and dirt-tight seal between housing 40 and end cap 42**.

After protective cover 10 is assembled with wire harness 14 as described above, ground junction connector 12 is connected to the ground point by moving lid 58 to the open position, placing the flat lower surface of housing 40 against body panel 38 or other planar surface to which ground junction connector 12 is to be attached, inserting bolt 34 through access hole 56 to pass through eyelet 32 and bolt hole 54, and tightening the bolt into nut 36. In the preferred embodiment of the invention, bolt hole 54 is approximately 6 millimeters in diameter to provide a tight clearance for bolt 34, and access hole 56 is approximately 18.5 millimeters in diameter to permit passage of a socket wrench (not shown) used to tighten the bolt. Once bolt 34 is properly tightened, lid 58 is moved to the closed position wherein plug 60 is inserted in access hole 56 to prevent the entry of contaminants into housing 40. If desired, a latch mechanism may be provided to hold lid 58 more securely in the closed position, many types of simple latch mechanisms appropriate for this task being known in the art.

Whereas a preferred embodiment of the invention has been illustrated and described in detail, it will be apparent that various changes may be made in the disclosed embodiment without departing from the scope or spirit of the invention.

What is claimed is:

1. A protective cover for enclosing a ground junction connector attached to a wire harness, the protective cover comprising:

first and second housing portions matingly engagable with one another to substantially enclose the ground junction connector, the first housing portion having a first hole for permitting electrical connection therethrough between the ground junction connector and a ground point and a second hole for permitting access therethrough to the ground junction connector from outside the housing, and the second housing portion having a third hole for passage therethrough of the wire harness, the first housing portion further having an open end for receiving the ground junction connector and comprising inner and outer skirts extending around at least a portion of a periphery of the open end and defining therebetween a gap, and the second housing portion comprising a peripheral wall insertable into the gap when the second housing portion is in said mating engagement with the first housing portion.

2. A protective cover according to claim 1 further comprising a lid closable to seal the second hole and openable to permit access to the ground junction connector.

3. A protective cover according to claim 2 wherein the lid is hingedly connected with the first housing portion for movement between open and closed positions.

4. A protective cover according to claim 1 wherein the ground junction connector includes an eyelet for receiving therethrough a fastener, and the first housing portion comprises spaced lower and upper walls, the first hole being formed in the lower wall for permitting passage therethrough of the fastener for connection to the ground point, and the second hole being formed in the upper wall in substantially coaxial alignment with the first hole for permitting passage therethrough of a tool for engaging the fastener.

5. A protective cover according to claim 1 wherein an inner surface of the outer skirt proximate the gap has at least one groove formed therein, and an outer surface of the peripheral wall has at least one ridge projecting therefrom for latching engagement with the groove when the peripheral wall is inserted into the gap, whereby the latching engagement secures the second housing portion and the first housing portion in said mating engagement with one another.

6. A protective cover for enclosing a ground junction connector having an attached wire harness, the protective cover comprising:

a housing having spaced upper and lower walls defining a hollow interior volume therebetween and having an open end to receive the ground junction connector into a substantially enclosed position within the interior volume of the housing with the wire harness extending through the open end, the lower wall having a first hole formed therein for permitting electrical connection therethrough between the around junction connector and a ground point, and the upper wall having a second hole formed therein in substantially coaxial alignment with the first hole for permitting access to the around junction connector to secure the ground junction connector in electrical connection with the ground point; and an end cap matingly engagable with the housing to substantially seal the open end and thereby trap the ground junction connector in the enclosed position, the end cap having an aperture for permitting passage therethrough of the wire harness when the ground junction connector is trapped in the enclosed position.

7. A protective cover according to claim 6 further comprising a lid for sealing the second hole when in a closed position and permitting access to the ground junction connector when in an open position.

8. A protective cover according to claim 7 wherein the lid is hingedly connected with the housing for movement between the open and closed positions.

9. A protective cover according to claim 6 wherein the second hole is sufficiently large to permit passage therethrough of a tool for engaging a fastener for securing the ground junction connector in electrical connection with the ground point.

10. A protective cover according to claim 6 wherein the housing comprises inner and outer skirts extending around at least a portion of the periphery of the open end of the housing and defining therebetween a gap, and the end cap comprises a peripheral wall for insertion into the gap when the end cap is matingly engaged with the housing.

11. A protective cover according to claim 10 wherein an inner surface of the outer skirt proximate the gap has at least one groove formed therein, and an outer surface of the peripheral wall has at least one ridge projecting therefrom for latching engagement with the groove when the peripheral wall is inserted into the gap, whereby the latching engagement secures the end cap and the housing in mating engagement with one another.

12. A wire harness having an attached ground junction connector and a protective cover for enclosing the ground junction connector, the protective cover comprising:

a housing having spaced lower and upper walls defining a hollow interior volume and having an open end to receive the ground junction connector into a substantially enclosed position within the interior volume of the housing between the lower and upper walls, the lower wall having a first hole formed therein for permitting electrical connection therethrough between the ground junction connector and a ground point, and the upper wall having a second hole formed therein in substantially coaxial alignment with the first hole for permitting access to the ground junction connector to secure the ground junction connector in electrical connection with the ground point, the wire harness extending through the open end when the ground junction connector is in the enclosed position; and an end cap matingly engagable with the housing to substantially seal the open end and thereby trap the ground junction connector in the enclosed position, the end cap having an aperture through which the wire harness extends when the ground junction connector is trapped in the enclosed position.

13. A wire harness according to claim 12 wherein the protective cover further comprises a lid for sealing the second hole when in a closed position and permitting access to the securing means when in an open position.

14. A wire harness according to claim 13 wherein the lid is hingedly connected with the housing for movement between the open and closed positions.

15. A wire harness according to claim 12 wherein the ground junction connector comprises an eyelet and a fastener insertable through the eyelet and through the first hole for connection to the ground point, and the second hole is sufficiently large to permit passage therethrough of a tool for engaging the fastener.

16. A wire harness according to claim 12 wherein the housing comprises inner and outer skirts extending around at least a portion of the periphery of the open end of the housing and defining therebetween a gap, and the end cap comprises a peripheral wall for insertion into the gap when the end cap is matingly engaged with the housing.

17. A wire harness according to claim 16 wherein an inner surface of the outer skirt proximate the gap has at least one groove formed therein, and an outer surface of the peripheral wall has at least one ridge projecting therefrom for latching engagement with the groove when the peripheral wall is inserted into the gap, whereby the latching engagement secures the end cap and the housing in mating engagement with one another.

* * * * *